US005354208A

United States Patent [19]

Salaski et al.

[11] Patent Number: 5,354,208

[45] Date of Patent: Oct. 11, 1994

[54] NEON TUBE CONNECTOR ASSEMBLY

[76] Inventors: Michael A. Salaski, 929 5th St. South, Sauk Rapids, Minn. 56379; Charles E. Kalscheuer, 207 4th Ave. Northeast, St. Cloud, Minn. 56379

[21] Appl. No.: 1,185

[22] Filed: Jan. 7, 1993

[51] Int. Cl.[5] ..... H01R 33/02

[52] U.S. Cl. ..... 439/230; 437/227; 437/239

[58] Field of Search ..... 439/226–236, 439/271, 280, 548, 559

[56] References Cited

U.S. PATENT DOCUMENTS

| | | | |
|---|---|---|---|
| 1,817,543 | 8/1931 | Ciraolo | 439/227 |
| 2,238,589 | 4/1941 | Hensler | 439/228 |
| 2,296,326 | 9/1942 | Barclay | 439/228 |
| 2,303,630 | 12/1942 | Goddard . | |
| 2,311,829 | 2/1943 | Hart | 439/235 |
| 2,451,539 | 10/1948 | Denning . | |
| 2,651,024 | 9/1953 | Miller . | |
| 2,654,870 | 10/1953 | Miller . | |
| 2,848,599 | 8/1958 | Charbonneaux | 439/234 |
| 3,906,217 | 9/1975 | Lackore | 439/226 |
| 4,434,569 | 3/1984 | Minogue . | |
| 4,954,099 | 9/1990 | Slowski et al. . | |
| 5,045,000 | 9/1991 | Trame et al. . | |
| 5,108,314 | 4/1992 | Takano et al. . | |

*Primary Examiner*—David L. Pirlot

*Attorney, Agent, or Firm*—Palmatier, Sjoquist & Helget

[57] ABSTRACT

A neon tube connector assembly for J-shaped ends of neon tubes, providing the electrical connection and mechanical support of the tube. The invention comprises a weather resistant enclosure with a removable cover and with a tube holder mounted on the inside base of the enclosure. The tube holder consists of opposing springs clips which provide a radial clamping force to the end cap at the tip of the J-shaped end. The curved neon tube passes through an aperture in a cover of the enclosure with elastomeric gasket material sealing the aperture. The tube passes through the aperture at the midpoint of the semicircular portion of the J-shaped end curve in the tube. The inside surface of the aperture and the gasket material cooperate to provide 360° of radial support on a plane parallel to the surface on which the connector assembly is mounted. The tube holder makes electrical connection with the tube to either connect with an adjacent tube and tube holder, or with the neon tube power source.

8 Claims, 3 Drawing Sheets

NEON TUBE CONNECTOR ASSEMBLY

BACKGROUND OF THE INVENTION

The invention disclosed relates to electrically illuminated tubes. More specifically, the invention relates to an apparatus for the electrical attachment and mechanical support for neon tubes with J-shaped ends.

Illuminated tubes have long been used for decorative or artistic display purposes and for illuminated signs. Illuminated tubes are formed of glass and filled with inert gasses such as argon, krypton, and most commonly, neon. Inside each end of a neon tube is an electrode which is connected to a lead wire or wires which pass through the sealed end of the glass tube. A power supply is applied to the electrodes at the opposing ends of the tubes causing the illuminating effect in the tube between the electrodes. The power supply for neon tubes ranges from 4,000–15,000 volts. The high voltage presents a shock hazard to personnel, especially individuals involved in the maintenance or replacement of neon tubes, and also presents a potential for fire with the resultant property damage, personal injury, or death.

Neon tubes have recently become popular in highlighting the outlines of structures including buildings. For this purpose neon tubes are typically arranged in a sequential, end-to-end, series configuration. For building perimeters, often six-foot sections of neon tubes will be used with their ends curved back in a "J" shaped manner. The J-shape configuration places the nonilluminating electrode portion of the tube behind the main body of the tube and adjacent to the building. This allows the tubes to be mounted in close proximity to each other minimizing gaps in the illumination. In this configuration neon tube supports are used to secure the tubes to the buildings and the lead wires from the adjacent tubes are typically twisted together for the electrical connection. This type of connection is not satisfactory for a number of reasons. The connection provides no mechanical support for the tube. Often the electrical integrity of the connection is lacking, especially after the replacement of a tube. The twisted together connection also may have exposed bare wire or conductor escalating the hazards associated with 4,000–15,000 volts discussed above. This type of connection also will typically require an electrician to make and break the connection, necessitating significant additional expense and inconvenience whenever a tube is replaced.

In many applications end caps are attached to the end of neon tubes allowing the electrical connection to be made to the metal end cap as opposed to the lead wire. Much of the prior art shows coiled wire springs which contact the end cap in axial direction necessitating supplemental support of the tube. None of the prior art found shows connecting assemblies designed for neon tubes with J-shaped ends. Nor does any of the prior art found provide mechanical support in two distinct locations on the tubes and in two distinct perpendicular planes. None of the prior art found provides a sealed weather resistant housing.

There is a need for a connecting assembly that provides readily accessible and convenient means for making mechanical and electrical connection to the J-shaped ends of neon tubes. The connecting assembly should be adaptable for standard fittings for the power supply line to enter the connector assembly and should be weather resistant. The assembly should provide a simple means for replacing neon tubes and it should minimize the gap between adjacent collinear tubes while concealing the nonilluminating portion of the tubes.

SUMMARY OF THE INVENTION

A neon tube connector assembly for J-shaped ends of neon tubes, providing the electrical connection and mechanical support of the tube. The invention comprises a weather resistant enclosure with a removable cover and with a tube holder mounted on the inside base of the enclosure. The tube holder consists of opposing spring clips which provide a radial clamping force to the end cap at the tip of the J-shaped end. The curved neon tube passes through an aperture in a cover of the enclosure with elastomeric gasket material sealing the aperture. The tube passes through the aperture at the midpoint of the curve in the tube. The inside surface of the aperture and the gasket material cooperate to provide 360° of radial support on a plane parallel to the surface on which the connector assembly is mounted. The tube holder makes an electrical connection with the tube so as to either connect with an adjacent tube and tube holder, or with the neon tube power source.

A principal object and advantage of the invention is that the assembly isolates uninsulated components within the housing minimizing any potential exposure to the high voltage incident with neon tube lighting.

A principal objective and advantage of the invention is to provide mechanical support to the neon tube. The spring clips and the elastomeric gasket material in the cover aperture provide radial support of the tube in two distinct perpendicular planes. In consideration that the connectors will be used in tandem, that is on each end of a neon tube, the need for supplemental tube supports between connector assemblies is eliminated or minimized.

Another object and advantage of the invention is that the assembly facilitates easy repair and replacement of the neon tubes.

Another object and advantage of the invention is that the assembly provides a weather resistant housing.

Another advantage is that the invention allows sequential collinear neon tubes to be mounted in close proximity to each other. Further, the invention provides optimal exposure of the illuminating portion of the tubes while concealing the nonilluminating portion containing the electrode in the housing.

DETAILED DESCRIPTION OF THE PREFERRED EMBODIMENTS

Figure 1:
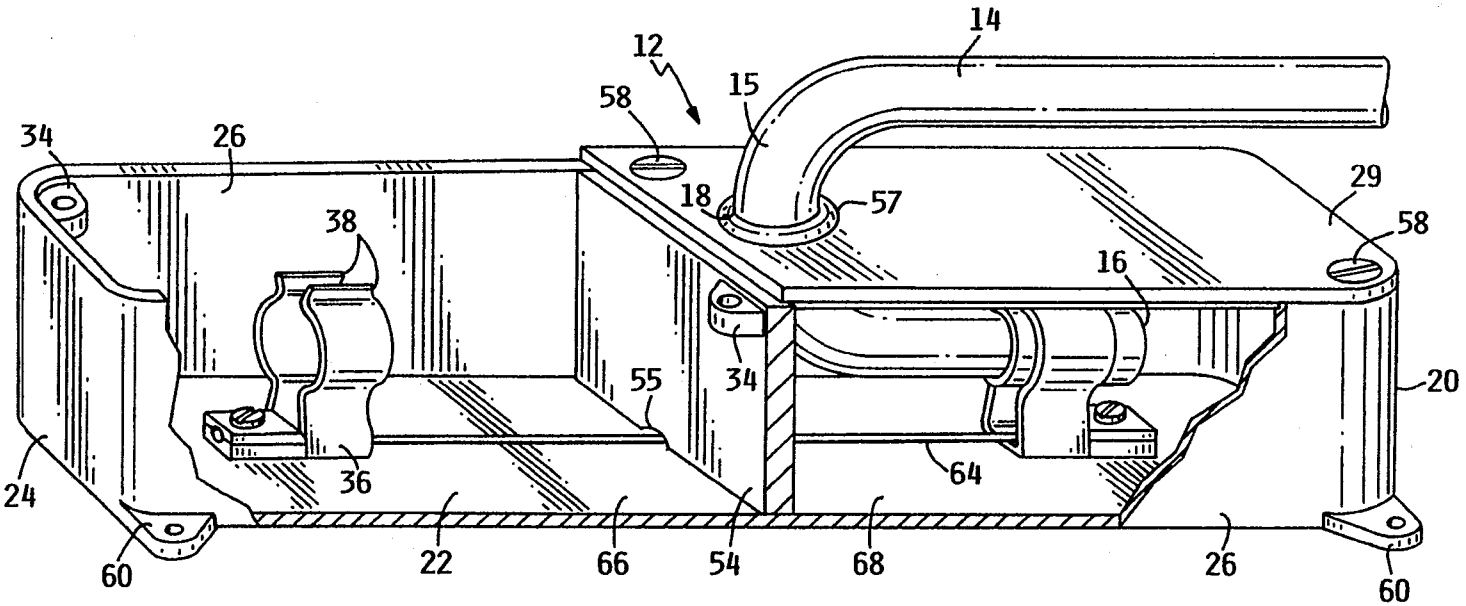
FIG. 1 is a perspective side view of the dual neon tube housing assembly with one side partially cut away, one cover removed, and a neon tube in place.

Referring to FIG. 1, the first embodiment of the invention shows a dual tube connector assembly 12. This embodiment is utilized for connecting adjacent ends of sequential neon tubes. Each neon tube 14 having a J-shaped end and a semicircular portion 15 with a midpoint 18. The assembly includes a housing 20 comprised of a base 22, two ends 24, and two sides 26. A partition 54 separates the housing 20 into a first compartment 66 and a second compartment 68. Housing lugs 60 are shown for mounting the housing to a building or other structure. The neon tube 10 exits the cover at the midpoint of the semicircular portion.

The neon tube holders 36 are shown in the housing assembly 20 opposing each other relative the partition 54. The neon tube holders 36 are suitably attached to the base 22. An electrical conductor 64 is shown connecting the two neon tube holders 36. The electrical conductor 64 runs along the base 22 of the housing assembly 20 and passes through the partition 54 by way of an aperture 55 of the partition 54.

Figure 3:
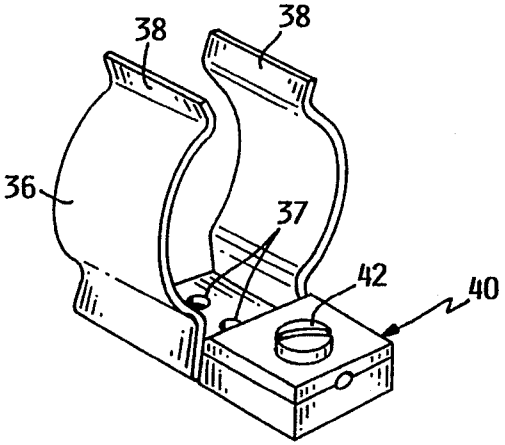
FIG. 3 is a perspective of a neon tube holder.
Figure 7:
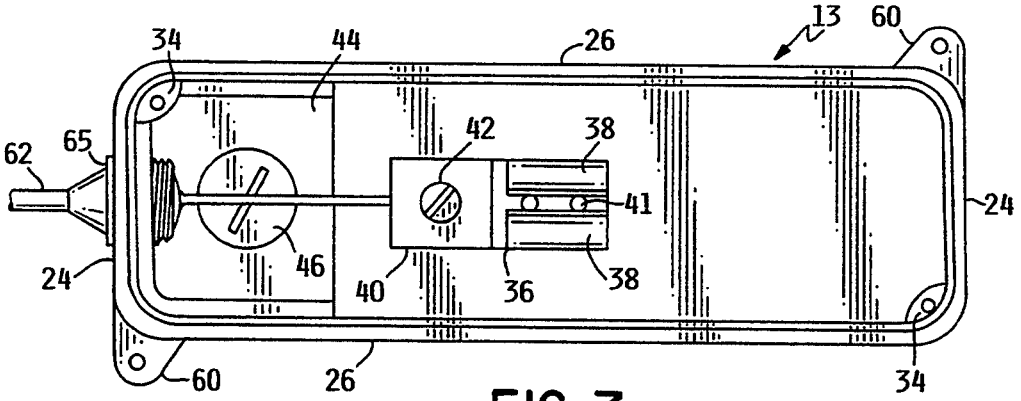
FIG. 7 shows a plan view of the single neon tube connector assembly with the cover removed.

FIG. 3 depicts the neon tube holder 36 in isolation. As can be seen, there are opposing metallic clamping pieces 38 which are sized to surround and clamp the conducting end tip 16. The neon tube holder 36 also has a lug portion 40 which provides a means for attaching the electrical conductor 64 or the external power supply line 62 for the neon tubes 14. A screw 42, shown in clamping configuration, is one suitable connection means. Also shown in FIG. 3 are two holes 37 to provide for the attachment of the tube holder 36 to the base 22 of the housing 20 by rivets 41 as shown in FIG. 7, or other suitable means.

Figure 2:
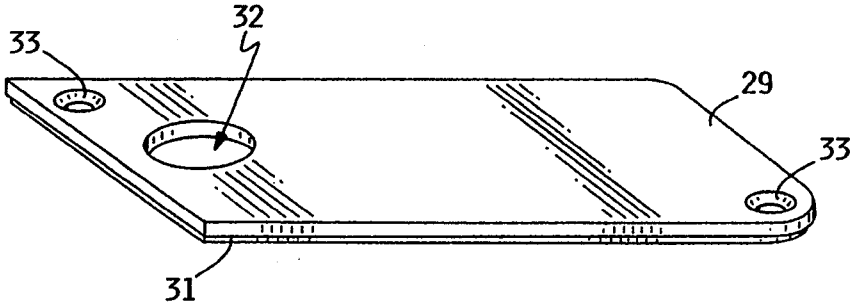
FIG. 2 is a perspective view of a cover for a dual neon tube connector assembly.

Depicted in FIG. 2 is a cover 29 for the dual neon tube connector assembly 12. Shown is a groove 31 along the exterior of the cover 29 which engages with the two sides 26, the end 24, and the partition 54, for each compartment 66, 68. The cover 29 has a neon tube aperture 32, which when attached on the connector assembly 12 is in close proximity to the partition 54. Holes 33 are shown which correspond to the lugs 34 in the housing.

A neon tube is installed in adjacent connector assemblies 12 by sliding the covers 29, 30 of the adjacent connector assemblies 12 on the tube 14 until the tube apertures 32 are at the midpoint 18 of the semicircular portion 15 of the tube 14. When the covers 29, 30 on both of the tubes 14 are so positioned, the tube end caps 16 may be inserted into the tube holders 36 in the adjacent connector assemblies 12. The covers 29, 30 are then fastened by way of the fastening screws 58 through the holes 33 in the covers 29,30 and into the housing cover lug 34.

Figure 4:
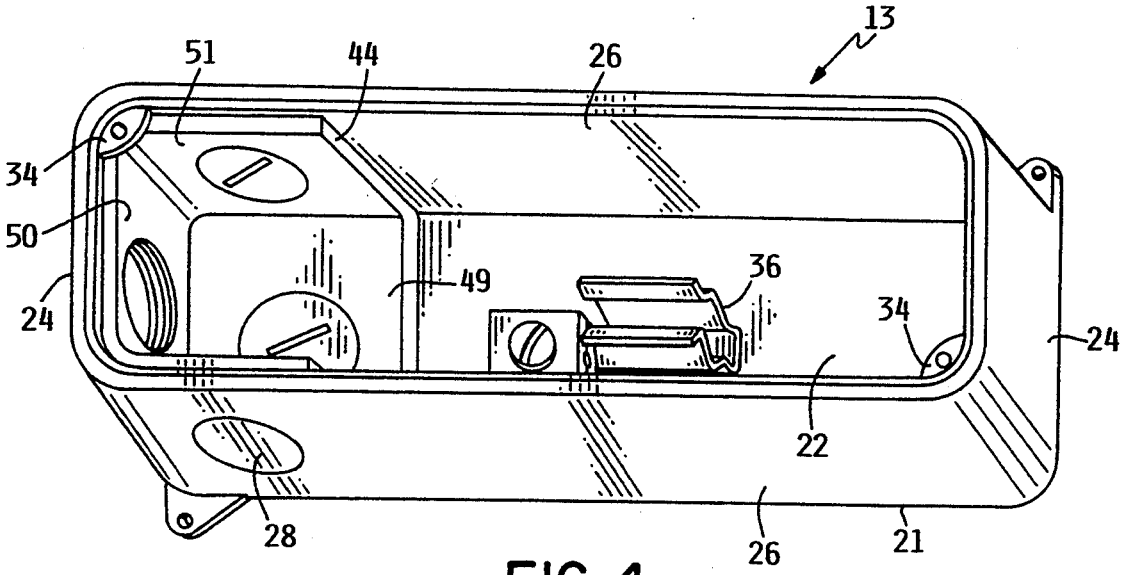
FIG. 4 is a perspective view of the single neon tube connector assembly.

FIG. 4 shows a second embodiment of the invention. Depicted is a single neon tube connector assembly 13. The assembly consists of a housing 21 comprised of opposing ends 24, two sides 26, and a base 22. Next to the base 22 is the neon tube holder 36. On the inside, adjacent to one end 24 of the housing 21, is located a housing insert 44.

Figure 5:
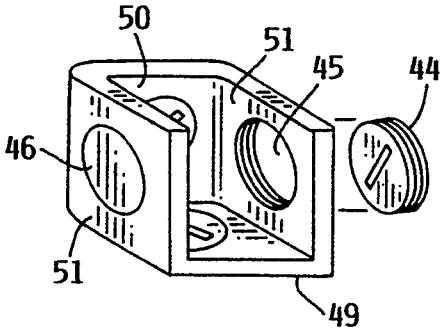
FIG. 5 is a perspective view of the housing insert for the single neon tube connector assembly.

FIG. 5 shows the housing insert 44 comprising two insert sides 51, insert end 50, and an insert base 49. Located in each is a hole 45 that has a threaded surface 48, sized to fit each hole 45 is a threaded plug 46. The housing insert 44 is sized to engage with the end 24, sides 26, and base 22 of the housing 21 and is suitably bonded or fastened in the housing 21.

The housing insert 44 provides additional structural stability and facilitates entrance into the housing 21 of the external power supply line 62. The housing 21 has knock-outs 28 sized and positioned to correspond to the location of the holes 45 in the housing insert 44. The threaded holes 46 in the housing insert 44 can be used to facilitate attachment to the housing 21 of a power line fitting 65 such as shown in FIG. 7. The threaded holes may be sized to accommodate commercial fittings. The knock-outs 28 may be fashioned by way of a circular cut substantially complete into the housing sides 26, end 24, and base 22 with sufficient material joining the knock-out 28 and the housing to secure the same in the housing 21 until forced removal of the knock-out 28.

Figure 6:
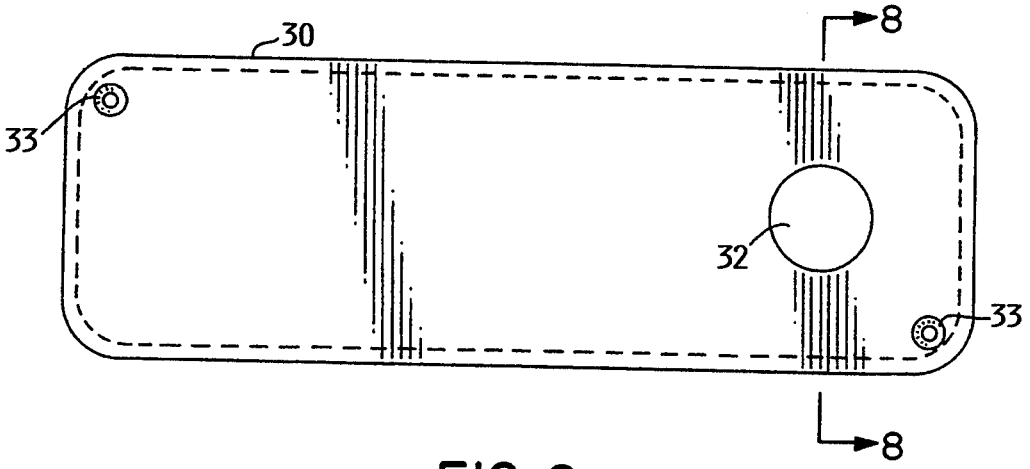
FIG. 6 shows a plan view of the cover for the single neon tube connector assembly.

FIG. 6 shows a cover 30 for the single neon tube connector assembly 13. The cover 30 has a tube aperture 32 appropriately sized to fit the neon tube 14. The cover 30 has a grooved edge 31 which engages the housing 21. The cover 30 includes two screw holes 33 which align with housing cover lugs 34 by which the cover 30 is thus secured by way of fastening screws 58.

Figure 8:
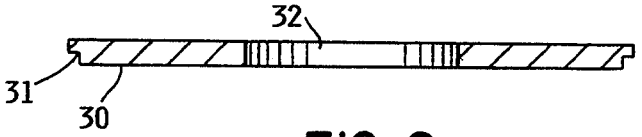
FIG. 8 is an enlarged cross sectional view taken on plane 8—8 of FIG. 6.

Shown in FIG. 8 is a cross section of the cover 30 taken on plane 7—7 of FIG. 6. The cross section depicts the groove 31 which engages with the housing 21. Also shown is the neon tube aperture 32.

Figure 9:
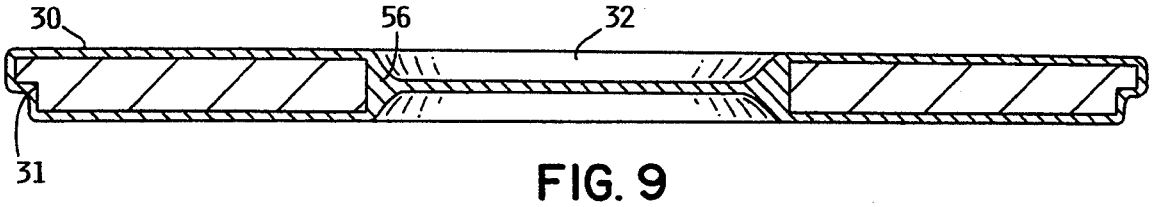
FIG. 9 is the cross sectional view of FIG. 8 enlarged and shown with elastomeric gasket material coating the cover and closing the aperture.

FIG. 9 depicts the same cross sectional area as FIG. 8 with an elastomeric gasket material 56 covering the surface of the cover 30. This can be accomplished by dip-coating the cover 30 in a suitable elastomeric material. As shown, the gasket material 56 may bridge the tube aperture 32. Upon insertion of a tube 14, the gasket material will be punctured, the remaining gasket material then forms a seal surrounding the neon tube 14 when the tube is inserted into the hole 32 and further provides mechanical support for the tube. In this embodiment the elastomeric gasket material 56 also effectively provides a seal between the cover 30 and the housing 21.

Figure 10:
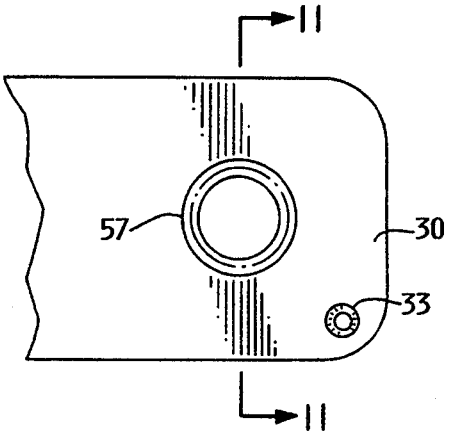
FIG. 10 is a plan view of a cover with a tube grommet in place.
Figure 11:
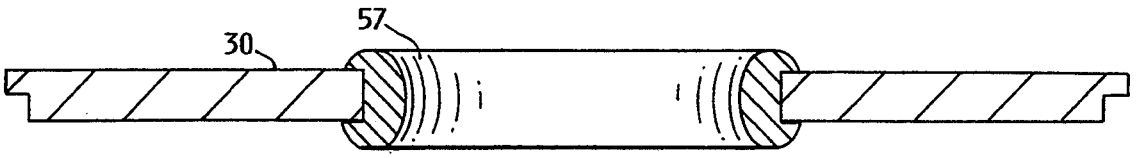
FIG. 11 is an enlarged cross section view of the plane 11—11 of FIG. 10.

FIGS. 10 and 11 show an alternative means of sealing the tube aperture 32 with a neon tube 14 in place. An elastomeric grommet 57 is inserted into the tube aperture 32 and, if desired, is affixed in place with a suitable adhesive.

The housing 20, 21 housing insert 44, partition 54, and covers 29, 30 may be composed of a wide range of materials including various plastic and ceramic materials. Due to the relatively simple configuration, the invention may be easily formed by way of injection molding.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A neon tube connector assembly for mechanically securing and electrically connecting neon tubes, the neon tubes having a J-shaped end with a semicircular portion, a midpoint of the semicircular portion, and a conducting end cap, the connector assembly comprising:

a housing with an open top formed of a rigid, nonporous material;

a cover removably mounted on the housing and closing the open top, the cover having a tube aperture, the housing and cover configured so that the neon tube exits through the aperture at the midpoint of the semicircular portion of the neon tube, the aperture sized to fit the neon tube at the midpoint;

a neon tube holder affixed within the housing comprising two clamping pieces electrically conductive and opposing each other, with a space between the clamping pieces sized to radially secure the neon tube end cap and to electrically connect with the neon tube end cap, and a connecting lug with an electrical attachment means; and an elastomeric material completely covering and adhering to the cover and wherein the elastomeric material extends a distance from the surface of the aperture allowing insertion and removal of the tube and providing a sealing engagement with the tube after insertion.

2. The connector assembly of claim 1, wherein the elastomeric material also provides a sealing engagement between the cover and the housing.

3. The neon tube connector assembly described in claim 1, wherein the housing comprises a base, a first end, a second end, a first side, and a second side all integral with each other and has a resistably removable circular knock-out, and the connector assembly further comprises a housing insert, the housing insert comprising:

an end piece, two side pieces, and a base piece, all integral with each other; and the housing insert sized to fit inside the housing and to engage the sides, the base and an end, the housing insert further having a circular hole with a threaded surface, the hole coaxial with and adjacent to the circular knock-out in the housing, whereby removal of the knock-out permits entrance into the housing of an external power supply line for connections to the lug by way of the electrical attachment means.

4. The connector assembly of claim 3 further comprising a removable threaded plug sized to fit the circular hole in the housing insert.

5. The connector assembly according to claim 4 further comprising a gasket that provides a sealing engagement between the neon tube and the cover.

6. The connector assembly of claim 5 further comprising a fitting sized to fit the circular hole with a threaded surface, wherein the fitting provides entrance of the power supply line into the housing and seals the hole.

7. A neon tube connector assembly for mechanically securing and electrically connecting sequential neon tubes, the neon tubes having J-shaped ends with semicircular portions, midpoints of the semicircular portions, and a conducting end cap, the connector assembly comprising:

a housing formed of rigid, nonporous material, the housing comprised of:

a base, two ends, two sides, all integral with each other, and an open top; and a partition connected to the two sides and the base defining two compartments;

two covers removably mounted on the respective compartments of the housing enclosing the open top;

each cover having a tube aperture sized to fit around the neon tubes, the housing sized so that the neon tubes exit through the tube apertures at the respective midpoints of the semicircular portion of the neon tubes;

a pair of neon tube holders, one located in each compartment affixed to the housing, each neon tube holder comprising two clamping pieces electrically conductive and opposing each other with a space between the clamping pieces oriented and sized to secure the neon tube ends in a parallel orientation to the base and to make electrical contact with the neon tube end caps and each tube holder also comprised of a connecting lug with an electrical attachment means;

a connecting conductor inside the housing electrically connecting the two tube holders; and an elastomeric material completely covering and adhering to the cover and wherein the elastomeric material extends a radial distance into the tube aperture allowing insertion and removal of the tube and providing a sealing engagement between the tube and cover when inserted.

8. The connector assembly of claim 7, wherein the elastomeric material also provides a sealing engagement between the cover and the housing when the cover is mounted on the housing.

* * * * *